US010859209B2

(12) United States Patent
Cola et al.

(10) Patent No.: US 10,859,209 B2
(45) Date of Patent: Dec. 8, 2020

(54) PRESSURE RECIPIENT

(71) Applicant: FABER INDUSTRIE S.P.A., Cividale del Friuli, Udine (IT)

(72) Inventors: Gianluigi Cola, Udine (IT); Raffaele Di Sarno, Udine (IT)

(73) Assignee: FABER INDUSTRIE S.P.A., Udine (IT)

( * ) Notice: Subject to any disclaimer, the term of this patent is extended or adjusted under 35 U.S.C. 154(b) by 21 days.

(21) Appl. No.: 16/313,335

(22) PCT Filed: Jun. 23, 2017

(86) PCT No.: PCT/IB2017/053755
§ 371 (c)(1),
(2) Date: Dec. 26, 2018

(87) PCT Pub. No.: WO2018/002788
PCT Pub. Date: Jan. 4, 2018

(65) Prior Publication Data

US 2019/0170300 A1 Jun. 6, 2019

(30) Foreign Application Priority Data

Jun. 28, 2016 (IT) ..... 102016000066798

(51) Int. Cl.
*F17C 13/00* (2006.01)
*F17C 1/16* (2006.01)

(52) U.S. Cl.
CPC ..... *F17C 13/002* (2013.01); *F17C 1/16* (2013.01); *F17C 13/00* (2013.01); *F17C 2203/0604* (2013.01); *F17C 2203/066* (2013.01); *F17C 2203/0619* (2013.01); *F17C 2203/0621* (2013.01); *F17C 2203/0663* (2013.01); *F17C 2203/0675* (2013.01); *F17C 2205/0305* (2013.01); *F17C 2209/2109* (2013.01); *F17C 2209/2118* (2013.01); *F17C 2209/2127* (2013.01);
(Continued)

(58) Field of Classification Search
CPC ..... F17C 13/002; F17C 13/00; F17C 1/16; F17C 2209/2109; F17C 2209/2118;
(Continued)

(56) References Cited

U.S. PATENT DOCUMENTS 5,429,845 A * 7/1995 Newhouse ..... F17C 1/16 138/30
5,476,189 A * 12/1995 Duvall ..... F17C 1/16 220/588
(Continued)

FOREIGN PATENT DOCUMENTS

DE 10 2010 023 386 A1 12/2011
JP H10-332082 A 12/1998

OTHER PUBLICATIONS

International Search Report and Written Opinion of the International Searching Authority for International Patent Application No. PCT/IB2017/053755 dated Sep. 20, 2017, 10 pages.

*Primary Examiner* — Kareen K Thomas
(74) *Attorney, Agent, or Firm* — Merchant & Gould P.C.

(57) ABSTRACT

A pressure recipient or vessel (1) has a polymeric impermeable liner (2) and a reinforcing layer (4) of a composite material externally formed around the impermeable liner (2), as well as at least one boss (5) coupled to the impermeable liner (2) and to the reinforcing layer (4) to provide an opening (6) of the pressure vessel (1). The impermeable liner (2) is joined to the boss (5) by a co-molded polymer-metal annular connection zone (7).

11 Claims, 4 Drawing Sheets

(52) U.S. Cl.
CPC ..... *F17C 2209/2154* (2013.01); *F17C 2209/227* (2013.01); *F17C 2260/036* (2013.01)

(58) Field of Classification Search
CPC ..... F17C 2260/036; F17C 2209/227; F17C 2209/2154; F17C 2209/2127; F17C 2205/0305; F17C 2203/0675; F17C 2203/0663; F17C 2203/066; F17C 2203/0621; F17C 2203/0619; F17C 2203/0604
USPC ..... 220/581, 582, 586, 587, 588, 589, 590, 220/591, 592; 215/40; 49/475.1
See application file for complete search history.

(56) References Cited

U.S. PATENT DOCUMENTS 5,518,141 A * 5/1996 Newhouse ..... F17C 1/16 220/586
5,798,156 A * 8/1998 Mitlitsky ..... F17C 1/16 138/30
6,227,402 B1 * 5/2001 Shimojima ..... F17C 1/16 220/581
6,230,922 B1 * 5/2001 Rasche ..... F17C 1/16 220/586
7,857,159 B2 * 12/2010 Lindner ..... F16J 15/062 220/586
7,861,887 B2 * 1/2011 Ota ..... F17C 1/16 220/581
8,696,491 B1 * 4/2014 Myers ..... A63B 53/0466 473/334
8,733,581 B1 * 5/2014 Olson ..... F17C 1/06 220/586
9,046,220 B2 * 6/2015 Patterson ..... F17C 1/16
2010/0025411 A1 2/2010 Otsubo et al.
2011/0210127 A1 9/2011 Strack et al.
2012/0205337 A1 8/2012 Holbach et al.
2017/0211747 A1 * 7/2017 Cola ..... F17C 1/06

* cited by examiner

PRESSURE RECIPIENT

This application is a National Stage Application of PCT/IB2017/053755, filed 23 Jun. 2017, which claims the benefit of Ser. No. 102016000066798, filed 28 Jun. 2016 in Italy, and which applications are incorporated herein by reference. To the extent appropriate, a claim of priority is made to each of the above-disclosed applications.

BACKGROUND OF THE INVENTION

The present invention relates to pressure recipients and, more in particular, to new systems and methods for pressure recipients of a composite material overwrapped by a reinforcing layer.

The development of advanced composite materials has enabled the production of lightweight pressure recipients of a composite overwrap material classified in different categories, for example, type 4 which indicates pressure recipients with a non-metal inner liner, and an outer composite reinforcing layer.

One of the critical aspects in manufacturing a type 4 pressure recipient is the interface between the non-metal inner liner and the metal boss which receives the valve and/or provides the connection of the pressure recipient with an external fluid duct.

The interface between the non-metal inner liner, typically plastic, and the metal boss must ensure a gastight seal capable of withstanding cyclic pressures and depressures throughout the life of the pressure recipient.

To this end, it is known to shape the inner plastic liner with a collar protruding in the axial direction of the boss and extending inside the boss up to the proximity of an internal thread for screwing the valve (FIG. 1). The valve is equipped with circumferential grooves housing O-Ring sealing rings which, once the valve has been screwed in the boss, engage the collar of the plastic liner and force it radially towards the outside, against the inner surface of the boss. In this way, an impermeable seal is provided in the interfaces valve—O-Ring—collar of the inner liner (FIGS. 1*a-c*, 2).

Known solutions pose a risk of permeability and leakage along the O-Rings, which increase over time and is due to the creep phenomenon (a gradual plastic deformation depending on time under constant stress condition) of the collar of the inner liner and of the insert of a thermoplastic material in the areas of contact with the gaskets, as shown in FIG. 2.

SUMMARY OF THE INVENTION

It is therefore the object of the present invention to improve the coupling between the non-metal inner liner and the metal boss of type 4 pressure recipients so as to ensure gas impermeability for higher operating durations.

This and other objects are achieved by means of a pressure recipient having a gas impermeable liner and a reinforcing layer of a composite material externally formed around the impermeable liner, as well as a boss coupled to the impermeable liner and to the reinforcing layer for providing an opening of the vessel connectable to an external duct, in which the impermeable liner is joined to the boss by means of a co-molded polymer-metal annular connection zone, without an elastomeric sealing ring.

The co-molded polymer-metal annular connection zone creates a stable and permanent bond between the non-metal impermeable liner and the metal boss.

In accordance with an aspect of the invention, in the annular connection zone the metal boss is lined by means of a polymeric intermediate layer co-molded with the metal material of the boss, and the polymeric impermeable liner is co-molded with the polymeric intermediate layer, in which the polymeric material of the intermediate layer has an adhesiveness to the metal of the boss greater than an adhesiveness of the polymeric material of the impermeable liner to the metal of the boss.

This allows to optimize the material properties in the impermeable liner for the function of impermeability against the stored gas, in the boss for the threaded connection of a closure valve and/or of an external duct, and in the polymeric intermediate layer (preferably non-elastomeric) for maximizing the bond and the adhesion between the polymeric material and the metal material of the boss. The intermediate layer also ensures a strong bond with the impermeable liner, by virtue of a polymer-polymer connection obtained by means of co-molding.

In accordance with a further aspect of the invention, the polymeric material of the impermeable liner has a gas impermeability greater than the gas impermeability of the material of the intermediate layer.

The lower gas impermeability of the intermediate layer allows, during the co-molding or over-molding processes, for a more complete evacuation of gas molecules from the interfaces polymer-metal and polymer-polymer and, therefore, a more intimate bond with greater adhesion forces between the boss and the intermediate layer and between the intermediate layer and the impermeable liner.

In accordance with a further aspect of the invention, the pressure recipient is manufactured by means of the following steps:

providing a boss of a metal material, pre-adhesive-fixing of the boss by means of the co-molding of a polymeric intermediate layer on the metal material of the boss, making a polymeric impermeable liner and co-molding the polymeric impermeable liner with the polymeric intermediate layer, overwrapping a reinforcing layer 4 so that, once completed the pressure recipient, the reinforcing layer extends externally around the impermeable liner and around at least one part of the boss, in which the polymeric material of the intermediate layer has an adhesiveness to the metal of the boss greater than an adhesiveness of the polymeric material of the impermeable liner to the metal of the boss.

BRIEF DESCRIPTION OF THE DRAWINGS

To better understand the invention and appreciate the advantages thereof, a number of non-limiting exemplary embodiments will be described below, with reference to the figures, in which.

DETAILED DESCRIPTION OF THE PREFERRED EMBODIMENT

Figure 1A:
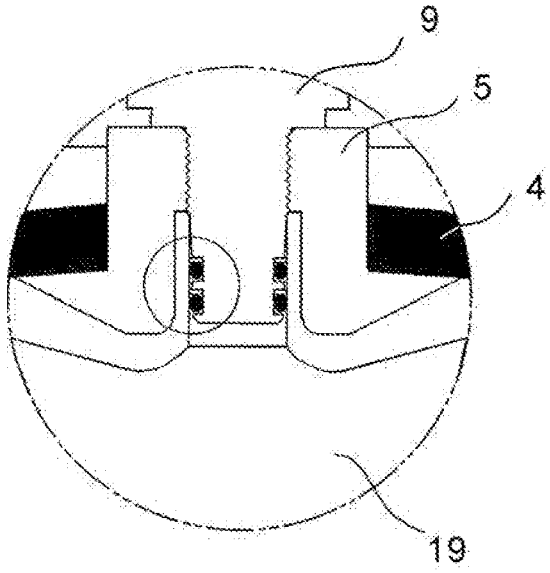
FIGS. 1*a, b, c* and 2 show a creep phenomenon in a coupling between the impermeable liner and the boss in a gas cylinder of the prior art.
Figure 1B:
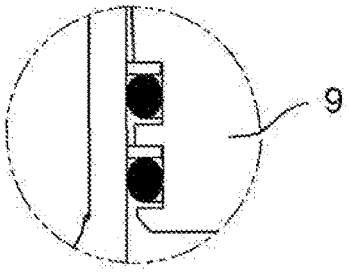
Figure 1C:
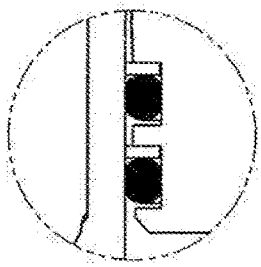
Figure 2:
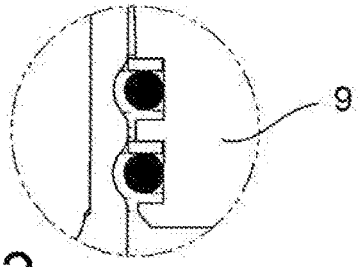
Figure 3:
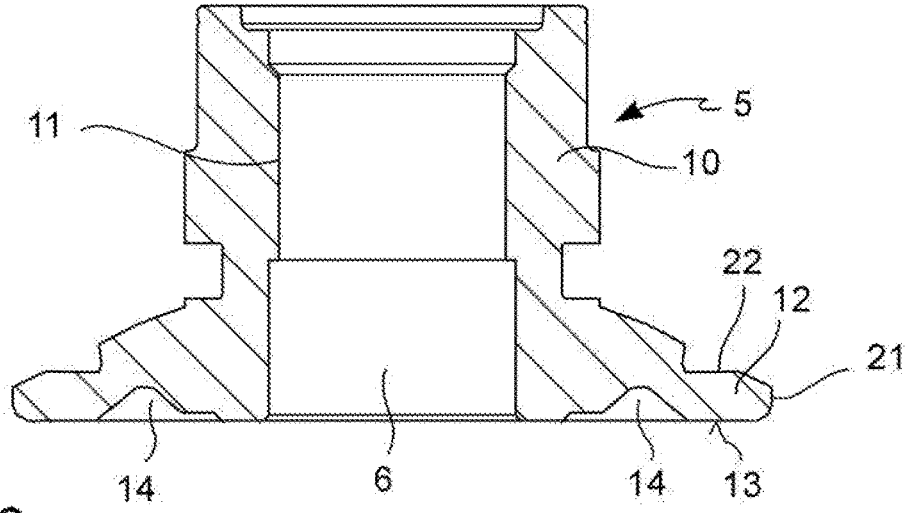
FIG. 3 shows a sectional view of a boss for a pressure recipient according to an embodiment.

With reference to FIGS. 3 to 10, a pressure recipient 1 has a gas impermeable liner 2 (usually the inner layer of the wall 3 of the vessel 1) and a reinforcing layer 4 of a composite material, externally formed around the impermeable liner 2, as well as at least one boss 5 coupled to the impermeable liner 2 and to the reinforcing layer 4 to provide an opening 6 of the pressure recipient 1, connectable to an external duct (not shown), in which the impermeable liner 2 is bonded to the boss 5 by means of a co-molded polymer-metal annular connection zone 7 without an elastomeric sealing ring.

The co-molded polymer-metal annular connection zone 7 creates a stable and permanent bond between the non-metal impermeable liner 2 and the metal boss 5.

In accordance with an aspect of the invention, in the annular connection zone 7 the metal boss 5 is lined with a polymeric intermediate layer 8 co-molded with the metal material of the boss 5, and the polymeric impermeable liner 2 is co-molded with the polymeric intermediate layer 8, in which the material of the polymeric intermediate layer 8 has an adhesiveness to the metal of the boss 5 greater than an adhesiveness of the polymeric material of the impermeable liner 2 to the metal of the boss 5.

This allows to optimize the material properties in the impermeable liner 2 for the function of impermeability to the stored gas, in the boss 5 for the threaded connection of a closure valve 9, and in the polymeric intermediate layer (preferably non-elastomeric) for maximizing the bond and the adhesion with the metal material of the boss 5. The intermediate layer 8 also ensures a strong bond with the impermeable liner 2, by virtue of the polymer-polymer connection obtained by means of co-molding or co-melting.

Furthermore, given the very limited volume of the intermediate layer 8 with respect to the impermeable layer 2, special and sometimes costly polymeric preparations may be used for the intermediate layer, but with excellent plastic-metal adhesion properties, without their cost affecting too much the overall cost of the vessel 1.

In accordance with an aspect of the invention, the material of the impermeable liner 2 has a gas impermeability greater than the gas impermeability of the material of the intermediate layer 8. Both materials are preferably thermoplastic, non-elastomeric plastics.

The lower gas impermeability of the intermediate layer 8 allows, during the co-molding or over-molding processes, for a more complete evacuation of gas molecules from the polymer-metal and polymer-polymer interface and, therefore, a more intimate bond with greater adhesion forces between the boss 5 and the intermediate layer 8 and between the intermediate layer 8 and the impermeable liner 2. On the other hand, the greater gas impermeability of the impermeable liner 2 prevents the gas stored under pressure from permeating through the wall 3 of the vessel 1. It should be noted that the term "impermeable liner" denotes the main function of the component and not an absolute gas impermeability that does not exist. Sometimes, in the technical language of the industry, in addition to the terms "impermeable liner" and "liner", the term "barrier liner" is also used.

According to an embodiment, the impermeable liner 2 is co-molded with both the intermediate layer 8 and the boss 5, so that the boss 5 and the impermeable liner 2 separate and isolate the intermediate layer 8 from a gas storage space 19 inside the vessel 1. In an embodiment (FIGS. 6, 7), the boss 5 and the impermeable liner 2 together completely encapsulate the intermediate layer 8.

This prevents a direct contact of the stored gas with the less impermeable material of the intermediate layer 8, thus matching the needs of a high plastic-metal adhesion with the need for a high impermeability also in the connection zone 7.

According to an embodiment (FIGS. 9, 10), the intermediate layer 8 is not limited to the sole plastic-metal connection zone 7, but it extends over the at least one cap or domed area of the vessel 1 or over the entire area of the impermeable liner 2 forming with the latter a two-layer, preferably co-molded, structure.

In an embodiment, the boss 5 comprises a tubular central portion 10 providing a passage for the pressurized fluid through the opening 6 of the vessel 1 and forming a threaded seat 11 (e.g. 1"⅛ 12 UNF) for the screwing of a valve 9. From the tubular portion 10 a coupling flange 12 protrudes, e.g. shaped as an annular disk forming the metal surface 13 for connecting the boss 5 to the intermediate layer 8 and to the impermeable liner 2. The boss 5 consisting of the tubular portion 10 and the connection flange 12 may be provided, for example, in steel (e.g. AISI316L) or aluminum (e.g. 6061T6), for example by means of machining, forging, molding works or a combinations of these work and forming processes.

In an embodiment, the coupling flange 12 forms an annular slit or groove 14 that is continuous or has circumferentially extending interrupted sections, facing towards the inside of the vessel 1 and suitable to increase the adhesion surface and the resistance of the plastic-metal connection between the boss 5 and the polymeric intermediate layer 8.

Advantageously, the intermediate layer 8 and the co-molded polymer-metal connection zone 7 extend from at least the inside of the groove 14 around a radially external edge 21 of the coupling flange 12 up to an external side 22 of the coupling flange 12 facing towards the outside of the vessel 1, so as to embrace the boss 5 with shape connection.

The impermeable liner 2 in polymeric material may for example be formed in polyamide (PA6 or PA66 or PA12), polyethylene (PE), high-density polyethylene (HDPE), acrylonitrile butadiene styrene (ABS), polypropylene (PP).

In an embodiment, the impermeable liner 2 is a multilayer liner with at least one barrier layer interposed between two layers having a gas impermeability lower than the gas impermeability of the barrier layer. The barrier layer may for example be in ethylene vinyl alcohol (EVOH).

The polymeric material of the impermeable liner 2 may be supplemented with carbon powder to prevent the accumulation of electrostatic charges.

The polymeric intermediate layer 8 may for example be formed in plastic material specific for the "rotolining" lining process. Preferably, a polymeric material adapted to form (with the boss 5) a very strong plastic-metal bond, even of a chemical type and (with the impermeable liner 2) a very strong plastic-plastic bond, of the co-penetrating type or even of the chemical type. Polymeric materials for "rotolining" are prior art per se and comprise for example:

ETFE (ethylene tetrafluoroethylene) is a partially fluorinated polymer, i.e. containing fluorine. ETFE is also known by the trademarks Tefzel® of DuPont, Fluon® of the Asahi Glass Company and Texlone of Vector Foiltec, ECTFE (ethylene chlorotrifluoroethylene) is a partially fluorinated polymer (a fluoropolymer) semi-crystalline which can be processed as a melted mass; chemically, it is a copolymer of ethylene and chlorotrifluoroethylene. ECTFE is marketed under the trademark Halar® ECTFE of Solvay Speciality Polymers.

polyethylene, e.g. Revolve® N-211 Rotolining Grade marketed by Matrix Polymers, ICORENE® 1869 Rotolining and ICORENE® 1870 Rotolining marketed by A. Schulmann Speciality Powders, polyethylene M-PE prepared by means of metallocene catalysts, cross-linked polyethylene, fluoropolymers, e.g. polyvinylidene difluoride (PVDF), ethylene vinyl alcohol (EVOH), polyamide (PA).

The material of the polymeric intermediate layer 8 may be supplemented with maleic anhydride so as to increase the adhesive capacity thereof, in particular for an adhesion to metal surfaces (of the boss), and the suitability thereof for a formation by means of rotolining.

Since such polymeric materials for rotolining are already known in the rotolining industry, are commercially available, and are not per se the subject of the present invention, for the purpose of a complete description of the invention, it is sufficient to specify that these are specifically prepared polymers and are intended for the rotolining of metal surfaces.

The reinforcing layer 4 has the function to withstand the internal pressure exerted by the stored fluid and may be manufactured by overwrapping continuous carbon fiber filaments impregnated with epoxy resin on the previously manufactured impermeable liner 2 or on a spindle which is subsequently removed.

The reinforcing fibers of the reinforcing layer 4 have a traction resistance greater than 4500 MPa, preferably between 4800 MPa and 5200 MPa, and an elastic modulus greater than 200 GPa, preferably between 200 and 250 GPa.

Advantageously, the reinforcing layer 5 comprises a (volumetric) content of reinforcing fibers comprised in the range between 50% vol and 70% vol, preferably between 55% vol and 65% vol, even more preferably approximately 60% vol, in which the rest of the volume is formed by the matrix which may be an epoxy resin or vinylester hardened by means of a heat treatment, for example heating at approximately 120° C. during approximately five hours.

Around the reinforcing layer 4, a further external protection layer may be provided, for example a layer of paint or an anti-shock layer.

In accordance with a further aspect of the invention, the pressure recipient 1 is manufactured by means of the following steps:

A) providing a boss 5 of a metal material,

B) pre-adhesive-fixing of the boss 5 by means of the co-molding of a polymeric intermediate layer 8 on a metal surface 13 of the boss 5, C) making a polymeric impermeable liner 2 and co-molding the impermeable liner 2 with the polymeric intermediate layer 8, D) overwrapping a reinforcing layer 4 so that, once completed the pressure recipient 1, the reinforcing layer extends externally around the impermeable liner 2 and around at least a part of the boss 5, in which the polymeric material of the intermediate layer 8 has an adhesiveness to the metal of the boss 5 greater than an adhesiveness of the polymeric material of the impermeable liner 2 to the metal of the boss 5.

During step A), the boss 5 may be formed with channels and/or recesses 15 to also create a shape connection and a better adhesion to the plastic of the intermediate layer 8, of the reinforcing layer 4, and possibly to the impermeable liner 2.

Prior to step B), a preparation step A1) of the metal surface 13 of the boss 5 may be carried out by means of one or more of:

providing a surface roughness, e.g. by means of grinding, sandblasting or mechanical sanding, pickling, degreasing or surface cleaning, e.g. by means of treatment with isopropanol soap, methyl ethyl ketone or other chemicals, plasma surface activation. Free radicals and the other particles in the highly active plasma may bind to the metal surface 13, resulting in the formation of additional polar groups having an improved chemical attraction to the polymeric material of the intermediate layer 8.

Figure 4:
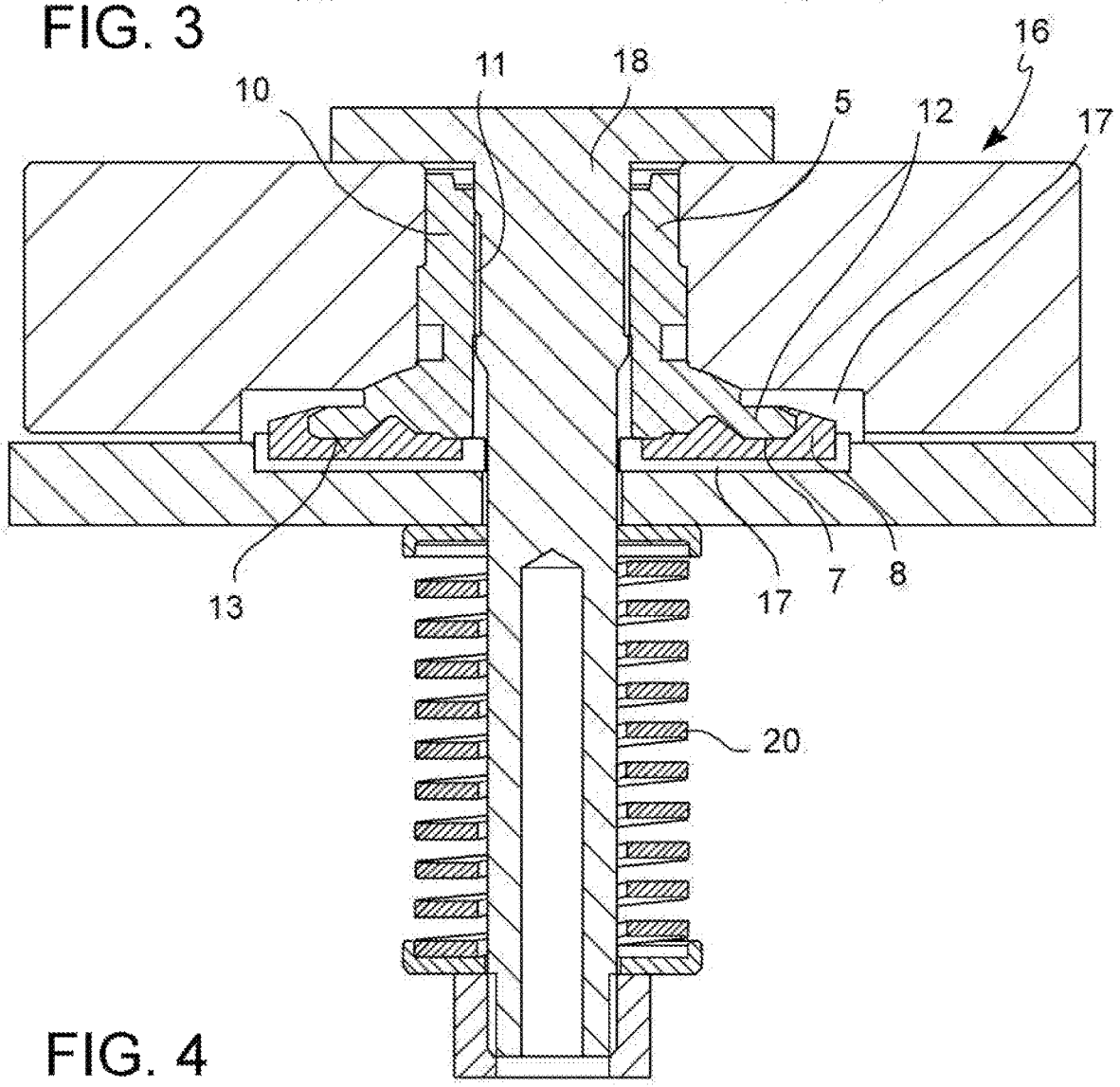
FIG. 4 shows a schematic sectional view of a mold during the co-molding or over-molding of a polymeric intermediate layer on a metal surface of the boss in FIG. 3.
Figure 5:
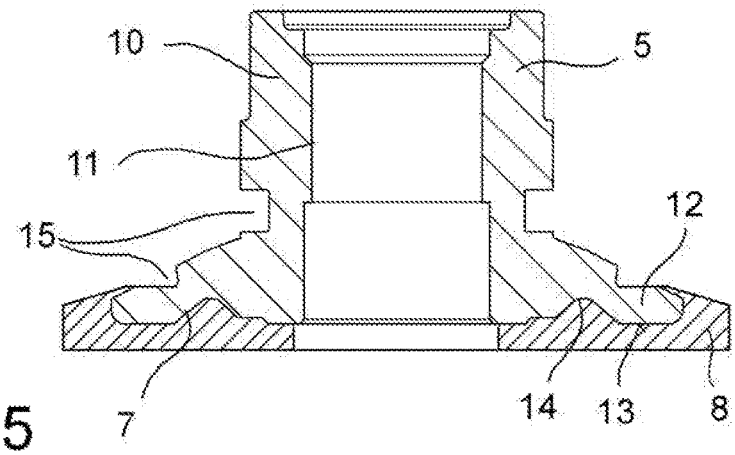
FIG. 5 shows a sectional view of the boss with the over-molded polymeric intermediate layer, after the extraction from the mold in FIG. 4.

During step B), a thermoforming mold 16 (FIG. 4) may be used, equipped with one or more inserts of a non-stick material or with non-stick liner, e.g. in PTFE, which delimit the surfaces of the intermediate layer 8 not involved in the plastic-metal co-molding with the metal surface 13 of the boss 5 (FIG. 4). In this way, an excessive (undesired) adhesion between the polymeric material of the intermediate layer 8 and the mold 16 is prevented.

The mold 16 may further comprise a centering screw 18 which may be inserted and screwed into the tubular portion 10 of the boss 5 and may be connected to the two half-molds of the mold 16 to perfectly center the boss 5 therewith. The mold 16 may further comprise a spring 20 which, during the entire molding step, applies an elastic preload on the two half-molds to compensate for volume reductions due to the gas evacuation from the polymeric mass of the intermediate layer 10.

According to an embodiment, during step B), the application of a depression or suction to the mold cavity 16 may be provided, e.g. a depression in the range between −0.1 bar and −0.3 bar, with respect to the ambient pressure, to facilitate the gas evacuation during the heating of the polymer of the intermediate layer 8.

The polymer for the intermediate layer 8 is inserted in the mold 16, e.g. between the non-stick inserts 17, in the form of powder, preferably of micronized powder with an average grain size below 1.2 micrometers. This contributes to minimizing the empty spaces between the individual plastic granules and therefore the excess air volume to be evacuated from the mold 16.

The mold 16 is heated to heat (for example, at approximately 160° C.-200° C.) and melt the polymer of the intermediate layer 8 and to perform the co-molding on the metal surface 13 of the boss 5. The cooling of the pre-adhesive-fixed boss 5 (equipped with the intermediate layer 8, FIG. 5) is carried out by means of air-cooling.

In an alternative embodiment (FIG. 8), step B) may comprise making the intermediate layer 8 with simultaneous over-molding of the intermediate layer 8 on the boss 5 by means of rotomolding. In this case, the boss 5 is fastened in a rotomolding mold (not shown) the molding cavity thereof defines the external shape of the intermediate layer 8 to be formed and which may be equipped with one or more inserts to cover the areas of the boss 5 (for example the threaded seat 11) which shall not be lined with plastic. The polymer for the intermediate layer 8, e.g. in the form of liquid or powder, preferably micronized for the reasons explained above, is loaded into the molding cavity of the rotomolding mold. The rotomolding mold is heated to melt the polymeric material for the intermediate layer 8 and is rotated about several axes to form the intermediate layer 8 on the mold surfaces and on the metal surface 13 of the boss exposed in the molding cavity. The cooling of the intermediate layer 8 thus formed may be carried out by means of water sprayed in air inserted into the mold, for example through the boss 5.

In this case (FIG. 8), after the extraction from the mold, a boss 5 is obtained with an intermediate layer 8 co-molded and extended over at least one cap or domed area of the recipient 1 or over the entire area of the impermeable liner 2 (still to be formed).

According to an embodiment, step C) may comprise making the impermeable liner 2 with a simultaneous over-molding of the impermeable liner 2 on the intermediate layer 8 and, if provided for, on the boss 5, by means of rotomolding. The pre-adhesive-fixed boss 5, i.e., the boss 5 together with the co-molded intermediate layer 8, is fastened in a rotomolding mold (not shown) the molding cavity thereof defines the external shape of the impermeable liner 2 to be formed or provides support to the intermediate layer 8 where the latter defines the external shape of the impermeable liner 2. The rotomolding mold may be equipped with one or more inserts to cover the areas of the boss 5 (for example the threaded seat 11) which shall not be lined with plastic. The polymer for the impermeable liner 2, e.g. in the form of liquid or powder, preferably micronized for the reasons explained above, is loaded into the molding cavity of the rotomolding mold. The rotomolding mold is heated to melt the polymeric material of the impermeable liner 2 and is rotated about several axes to form the impermeable liner 2 on the surface of the intermediate layer 8, as well as (if present) on the mold surfaces and/or on the metal surface 13 of the boss 5 exposed in the molding cavity. The cooling of the co-molded body thus formed may be carried out by means of water sprayed in air inserted into the mold, for example through the boss 5.

Figure 6:
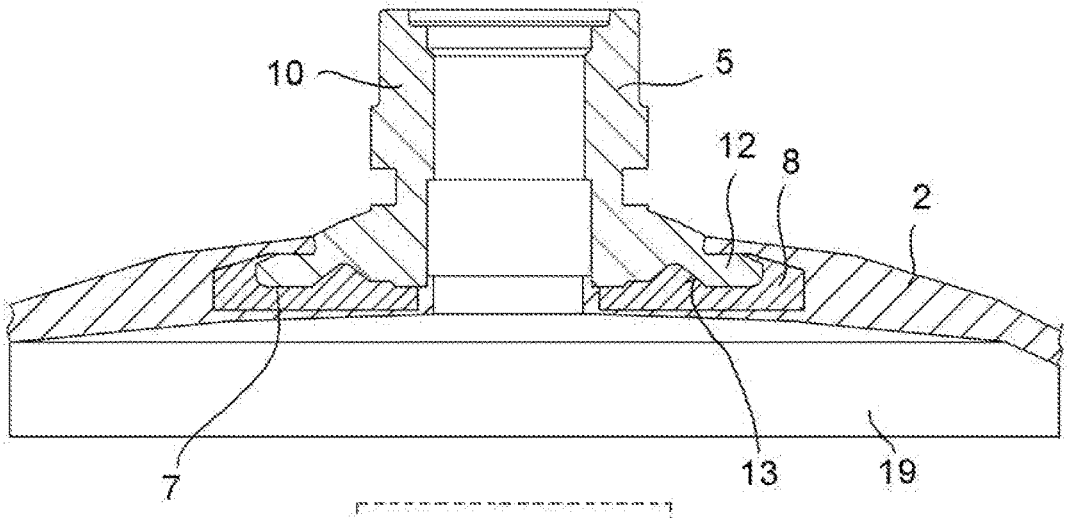
FIG. 6 shows a sectional view of the boss with the polymeric intermediate layer over-molded on the metal surface of the boss and with a polymeric impermeable liner co-molded with the polymeric intermediate layer and with the boss.
Figure 7:
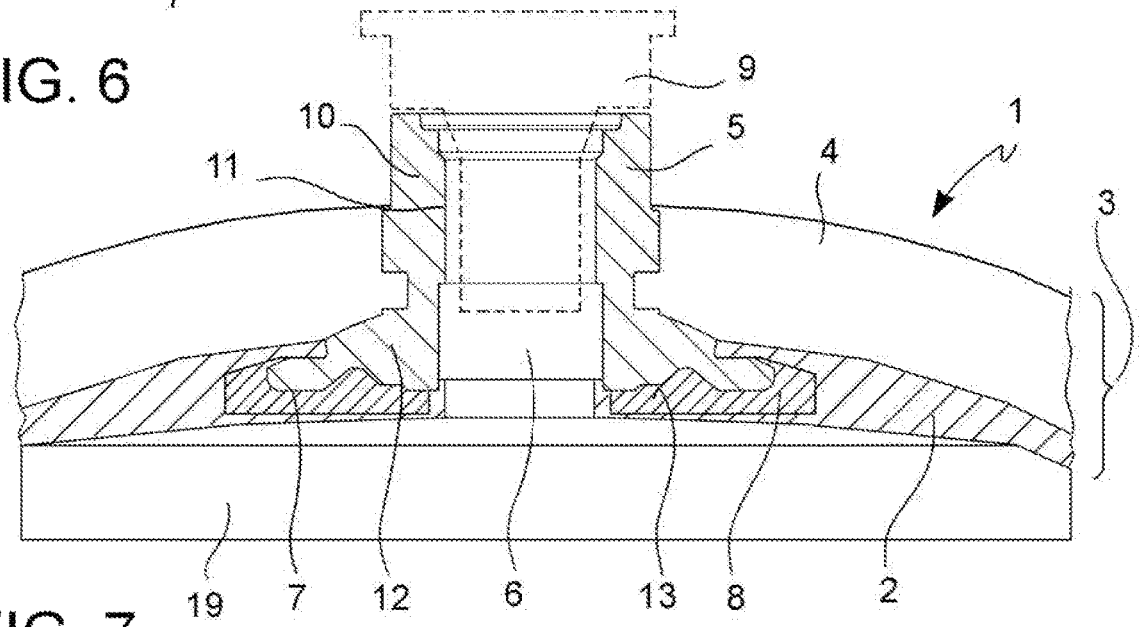
FIG. 7 shows a sectional view of the boss area of a pressure recipient complete with a reinforcing layer.
Figure 8:
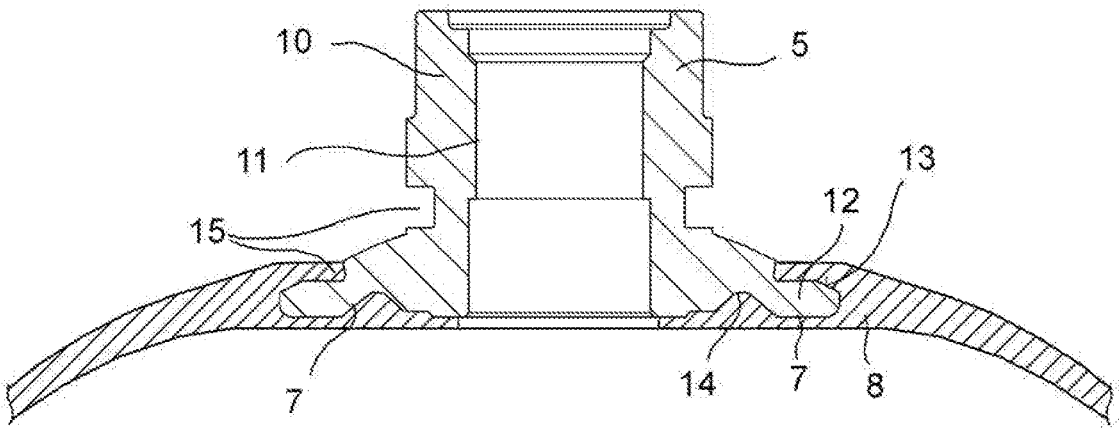
FIG. 8 shows a sectional view of the boss with a polymeric intermediate layer co-molded and extended over the cap area of the pressure recipient, according to a second embodiment.
Figure 9:
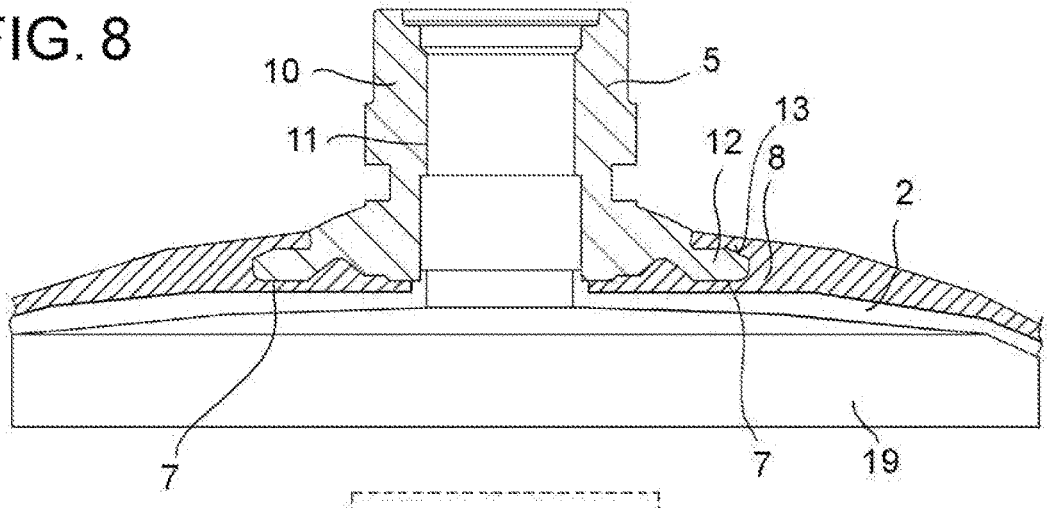
FIG. 9 shows a sectional view of the boss with the intermediate layer of FIG. 8 and with a polymeric impermeable liner co-molded with both the polymeric intermediate layer and the boss, according to the second embodiment.
Figure 10:
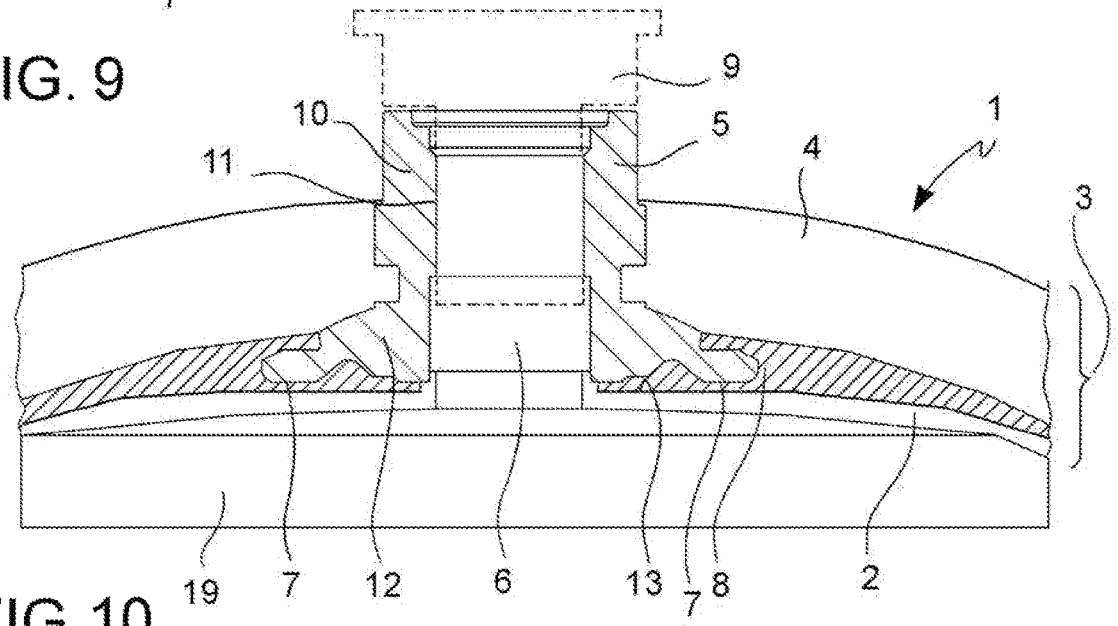
FIG. 10 shows a sectional view of the boss area of a pressure recipient complete with a reinforcing layer, according to the second embodiment.

After the extraction from the rotomolding mold, a co-molded boss 5—intermediate layer 8—impermeable liner 2 assembly is obtained (FIGS. 6, 9).

According to a further embodiment, step C) may comprise making the impermeable liner 2 with a simultaneous over-molding of the impermeable liner 2 on the intermediate layer 8 and, if present, on the boss 5 by means of blowing molding, in which the pre-adhesive-fixed boss, i.e., the boss 5 together with the co-molded intermediate layer 8 and the polymeric preform for the inner liner 2, are fastened in a blow molding mold (not shown) the molding cavity thereof defines the external shape of the impermeable liner 2 to be formed or provides support to the intermediate layer 8 where the latter defines the external shape of the impermeable liner 2. Furthermore, the polymer for forming the impermeable liner 2 and/or the polymer of the intermediate layer 8 is heated during or upon completion of the blowing of the impermeable liner 2 at a melting temperature to obtain the co-molding between the impermeable liner 2 and the intermediate layer 8 and, if present, the boss 5.

According to an embodiment, step D) comprises the overwrapping of the reinforcing layer 4 around the co-molded body formed by the boss 5, the intermediate layer 8 and the impermeable liner 2.

In a simplified embodiment, both the intermediate layer 8 and the impermeable liner 2 are of a polymeric material for rotolining and are formed and co-molded to the boss 5 in a single rotomolding process. In this case, both the material of the intermediate layer 8 and the material of the impermeable liner 2 may be supplemented with maleic anhydride to improve the adhesion with the metal of the boss and the workability by means of rotomolding.

The pressure recipient 1, manufactured and configured according to the described embodiments, may be used, for example, as a gas cylinder or as a pressure accumulator.

Last but not least, it is noted that the pressure recipient 1 according to the invention does not require ad hoc valves to work with the inner sealing liner and may be used with the commercial valves typically available on the market. The valve, therefore, does not engage the inner sealing liner and not even the polymeric intermediate layer, neither directly nor indirectly, by means of O-Ring gaskets, and is positioned at a distance from the inner sealing liner and from the polymeric intermediate layer.

In contrast, the prior art recipients require valves specially designed to house and stress the sealing O-ring in engagement with the plastic inner sealing liner.

Meaning of Permeability—Impermeability

In physics and engineering, permeation/permeability (also called imbuing) is the penetration of a permeate (such as a liquid, gas, or vapor) through a solid. It is directly related to the concentration gradient of the permeate, a material's intrinsic permeability, and the materials' mass diffusivity. Permeation is modeled by equations such as Fick's laws of diffusion, and can be measured using tools such as a minipermeameter.

The process of permeation involves the diffusion of molecules, called the permeant, through a membrane or interface. Permeation works through diffusion; the permeant will move from high concentration to low concentration across the interface. Permeation can occur through most materials including metals and polymers. However, the permeability of metals is much lower than that of polymers due to their crystal structure and porosity.

Permeation is something that must be regarded highly in various polymer applications, due to their high permeability. Permeability depends on the temperature of the interaction as well as the characteristics of both the polymer and the permeant component. Through the process of sorption, molecules of the permeant can be either absorbed or adsorbed at the interface. The permeation of a material can be measured through numerous methods that quantify the permeability of a substance through a specific material.

Permeability due to diffusion is measured in SI units of mol·/m·s·Pa although Barrers are also commonly used.

In the present disclosure, the term "gas impermeability" or "gas tightness" denotes the desired inverse property with respect to the property of permeability/permeation, in particular with reference to the gas stored in the container, for example hydrogen, methane, propane, etc.

Meaning of Adhesion—Adhesivity

Adhesion is the tendency of dissimilar particles or surfaces to cling to one another (cohesion refers to the tendency of similar or identical particles/surfaces to cling to one another). The forces that cause adhesion and cohesion can be divided into several types. The intermolecular forces responsible for the function of various kinds of stickers and sticky tape fall into the categories of chemical adhesion, dispersive adhesion, and diffusive adhesion. In addition to the cumulative magnitudes of these intermolecular forces, there are certain emergent mechanical effects.

Two materials may form a compound at the joint. The strongest joints are where atoms of the two materials swap or share electrons (known as ionic bonding or covalent bonding, respectively). A weaker bond is formed if a hydrogen atom in one molecule is attracted to an atom of nitrogen, oxygen, or fluorine in another molecule, a phenomenon called hydrogen bonding."

Chemical adhesion occurs when the surface atoms of two separate surfaces form ionic, covalent, or hydrogen bonds. The engineering principle behind chemical adhesion in this sense is fairly straightforward: if surface molecules can bond, then the surfaces will be bonded together by a network of these bonds. It bears mentioning that these attractive ionic and covalent forces are effective over only very small distances—less than a nanometer. This means in general not only that surfaces with the potential for chemical bonding need to be brought very close together, but also that these bonds are fairly brittle, since the surfaces then need to be kept close together.

Adhesion or adhesivity is measurable by measuring the force needed to win the connection of two materials in a link interface, such as a co-moulding interface, having a known area.

The invention claimed is:

1. A pressure vessel comprising: a polymeric impermeable liner and a reinforcing layer of a composite material externally formed around the impermeable liner; at least one boss coupled to the impermeable liner and to the reinforcing layer to provide an opening of the pressure vessel, wherein the impermeable liner is joined to the boss by a co-molded polymer-metal annular connection zone;

wherein the metal boss is lined with a polymeric intermediate layer in the annular connection zone and a valve is screwed into the boss, and said valve is spaced apart from the impermeable liner and from the intermediate layer and engages neither the impermeable liner nor the intermediate layer.

2. A pressure vessel according to claim 1, wherein the polymeric intermediate layer is co-molded with a metal surface of the boss, and the impermeable liner is co-molded with the polymeric intermediate layer, wherein material of the polymeric intermediate layer has an adhesiveness to the metal of the boss greater than an adhesiveness of the polymeric material of the impermeable liner to the metal of the boss.

3. A pressure vessel according to claim 2, wherein the material of the impermeable liner has a gas impermeability greater than a gas impermeability of the material of the intermediate layer.

4. A pressure vessel according to claim 2, wherein the impermeable liner is co-molded with both the intermediate layer and with the boss, and the boss and the impermeable liner separate and isolate the intermediate layer from a gas storage space inside the vessel.

5. A pressure vessel according to claim 4, wherein the boss and the impermeable liner completely encapsulate the intermediate layer.

6. A pressure vessel according to claim 2, wherein the intermediate layer extends over at least one cap or domed area of the vessel or over the entire area of the impermeable liner and forms with the impermeable liner a co-molded two-layer structure.

7. A pressure vessel according to claim 2, wherein the boss comprises:

a tubular central portion which forms a passage for pressurized fluid through the opening of the vessel and forms a threaded seat for screwing of a valve, a coupling flange protruding from the tubular portion and forming an annular groove facing towards inside the vessel, said annular groove being continuous or interrupted, wherein the intermediate layer and the co-molded polymer-metal connection zone extend from at least an inside of the groove around a radially external edge of the coupling flange up to an external side of the coupling flange facing towards outside the vessel, so as to embrace the boss with shape connection.

8. A pressure vessel according to claim 1, wherein the impermeable liner of a polymeric material is selected from the group consisting of PA6 or PA66 or PA12 polyamide, polyethylene, high-density polyethylene, acrylonitrile butadiene styrene, polypropylene, polymeric material containing carbon powder.

9. A pressure vessel according to claim 1, wherein the impermeable liner is a multilayer liner with at least one barrier layer interposed between two layers having a gas impermeability lower than a gas impermeability of the barrier layer.

10. A pressure vessel according to claim 1, wherein the polymeric intermedia layer is made of plastic material specific for a rotolining lining process, or of a material selected from the group consisting of:

ETFE (ethylene tetrafluoroethylene),
ECTFE (ethylene chlorotrifluoroethylene),
polyethylene Revolve® N-211 Rotolining Grade,
polyethylene ICORENE® 1869 Rotolining,
polyethylene ICORENE® 1870 Rotolining,
poyethylene M-PE prepared by metallocene catalysts,
cross-linked polyethylene,
fluoropolymers,
polyvinylidene difluoride (PVDF),
ethylene vinyl alcohol (EVOH),
polyamide (PA).

11. A pressure vessel comprising:

a polymeric impermeable liner and a reinforcing layer of a composite material externally formed around the impermeable liner; at least one boss coupled to the impermeable liner and to the reinforcing layer to provide an opening of the pressure vessel, wherein the impermeable liner is joined to the boss by a co-molded polymer-metal annular connection zone;

wherein the metal boss is lined with a polymeric intermediate layer in the annular connection zone, co-molded with a metal surface of the boss, and the impermeable liner is co-molded with the polymeric intermediate layer, wherein material of the polymeric intermediate layer has an adhesiveness to the metal of the boss greater than an adhesiveness of the polymeric material of the impermeable liner to the metal of the boss; and wherein a valve is screwed into the boss and said valve is distant from the impermeable liner and from the intermediate layer and does not engage the impermeable liner nor the intermediate layer.

* * * * *